US006332231B1

(12) United States Patent
Wang

(10) Patent No.: US 6,332,231 B1
(45) Date of Patent: Dec. 25, 2001

(54) COLLAPSIBLE LEAF FOR A PLAYPEN

(76) Inventor: Kun Wang, No. 56, Min Sheng Street, Feng-Yuan City 42041 (TW)

( * ) Notice: Subject to any disclaimer, the term of this patent is extended or adjusted under 35 U.S.C. 154(b) by 0 days.

(21) Appl. No.: 09/542,039

(22) Filed: Mar. 31, 2000

(51) Int. Cl.[7] ..... A47C 27/08
(52) U.S. Cl. ..... 5/507.1; 5/503.1; 5/658
(58) Field of Search ..... 5/503.1, 507.1, 5/93.1, 98.1, 99.1, 97, 658; 256/23, 25, 26; 403/65, 93

(56) References Cited

U.S. PATENT DOCUMENTS 3,735,430 * 5/1973 Platz ..... 5/93.1
5,349,709 * 9/1994 Cheng ..... 5/93.1
5,778,465 * 7/1998 Myers ..... 5/99.1
5,918,329 * 6/1999 Huang ..... 5/93.1

* cited by examiner

*Primary Examiner*—Lynne H. Browne
*Assistant Examiner*—Fredrick Conley

(57) ABSTRACT

A collapsible leaf for a playpen includes a pair of longitudinal bars and a pair of transverse bars releasibly connected at their ends by four corner members and wrapped with piece of cloth a first pair suspenders suspend the pair of transverse bars from a pair of upper rails of the playpen and a second pair of suspenders suspending one of the longitudinal bars from an upper rail of the playpen. The suspenders each has a strap, connected with a buckle and hinged with a hook which includes an elastic pate to facilitate the hook releasable held the rails of the playpen.

1 Claim, 8 Drawing Sheets

(3—3)

(4—4)

(6—6)

COLLAPSIBLE LEAF FOR A PLAYPEN

BACKGROUND OF THE INVENTION

The present invention relates of playpens and more particularly to a structure of a collapsible leaf for a playpen which leaf is usually attached to one side of the playpen without disturbing the baby playing in the playpen and is supportable on the top of the playpen for placing the things such as toys, milk or the other objects required.

Conventionally, a playpen has no place to put the things required to feed a baby. Thus, the producer provides a collapsible leaf attached to a playpen (as shown in FIG. 1). The collapsible leaf includes a rectangular frame 1 covered up with cloth 30, a pair of supports 2 symmetrically secured under a pair of transverse bars of the frame 1 by rivets 6 and each having a semi-circular slot 8 engageable with the top of the ails 4 of a playpen respectively and a pair of hinges 3 each having pair of transverse through holes for respectively coupling with a longitudinal bar of the frame 1 and the rail 41 of the playpen. So that the leaf is able to for about 180° to hang on the rail 41 and the top of the transverse bars lean on the uprights 9 of the playpen. However, this collapsible leaf has a disadvantage that the hinges 3 are difficult to assemble to the rail 41. Besides, a hanging object without fixing to the uprights is unstable.

SUMMARY OF THE PRESENT INVENTION

The present invention has a main object to provide a collapsible leaf for a playpen. The collapsible leaf is suspended from the playpen and is readily to assemble or disassemble with the playpen.

Another object of the present invention is to provide a collapsible leaf for a playpen. When the collapsible leaf is collapsed, it can be fixed to a pair of uprights of the playpen.

The present invention will become more fully understood by reference to the following detailed description thereof when read in conjunction with the attached drawings.

DETAILED DESCRIPTION OF THE PREFERRED EMBODIMENT

Figure 1:
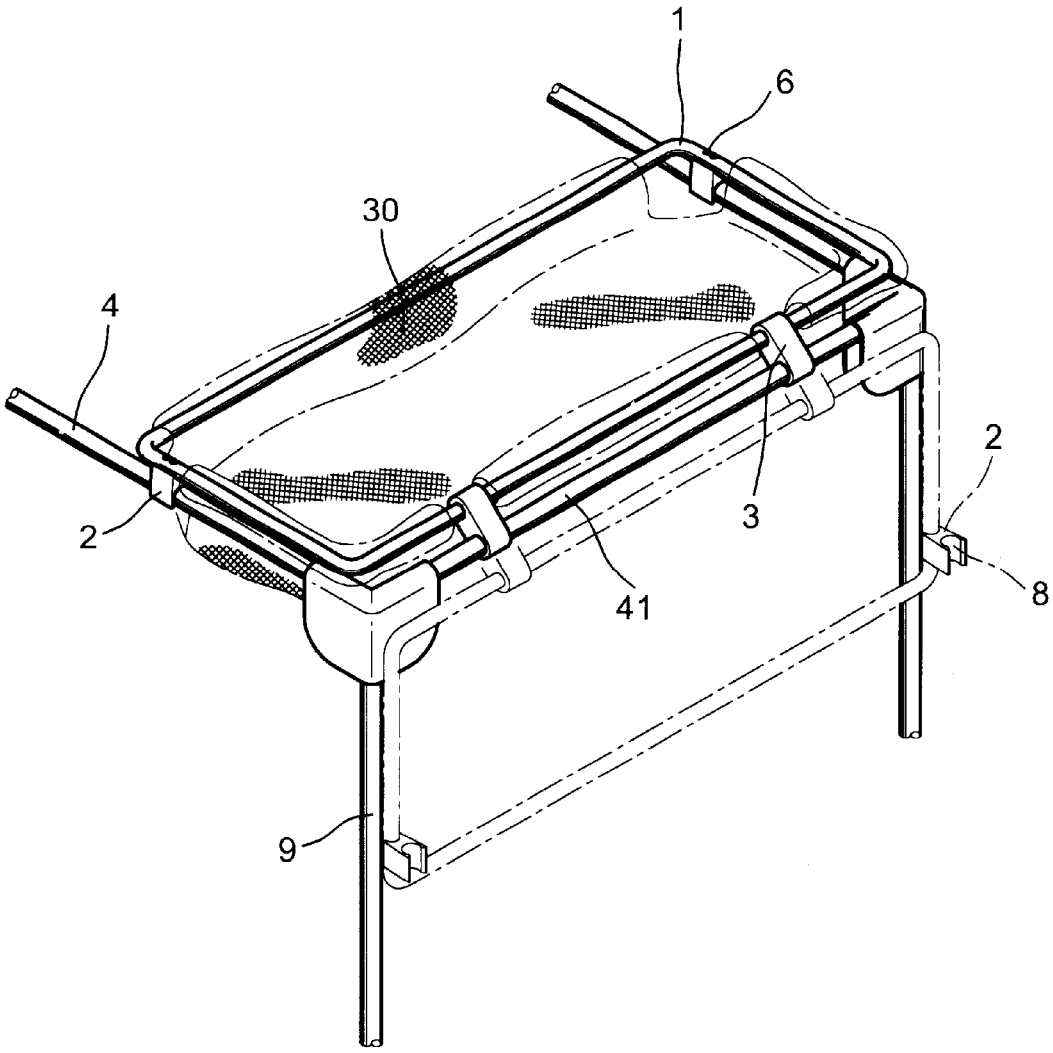
FIG.1 Prior Art
FIG. 1 is a perspective view to show a collapsible leaf according to a prior art.
Figure 2:
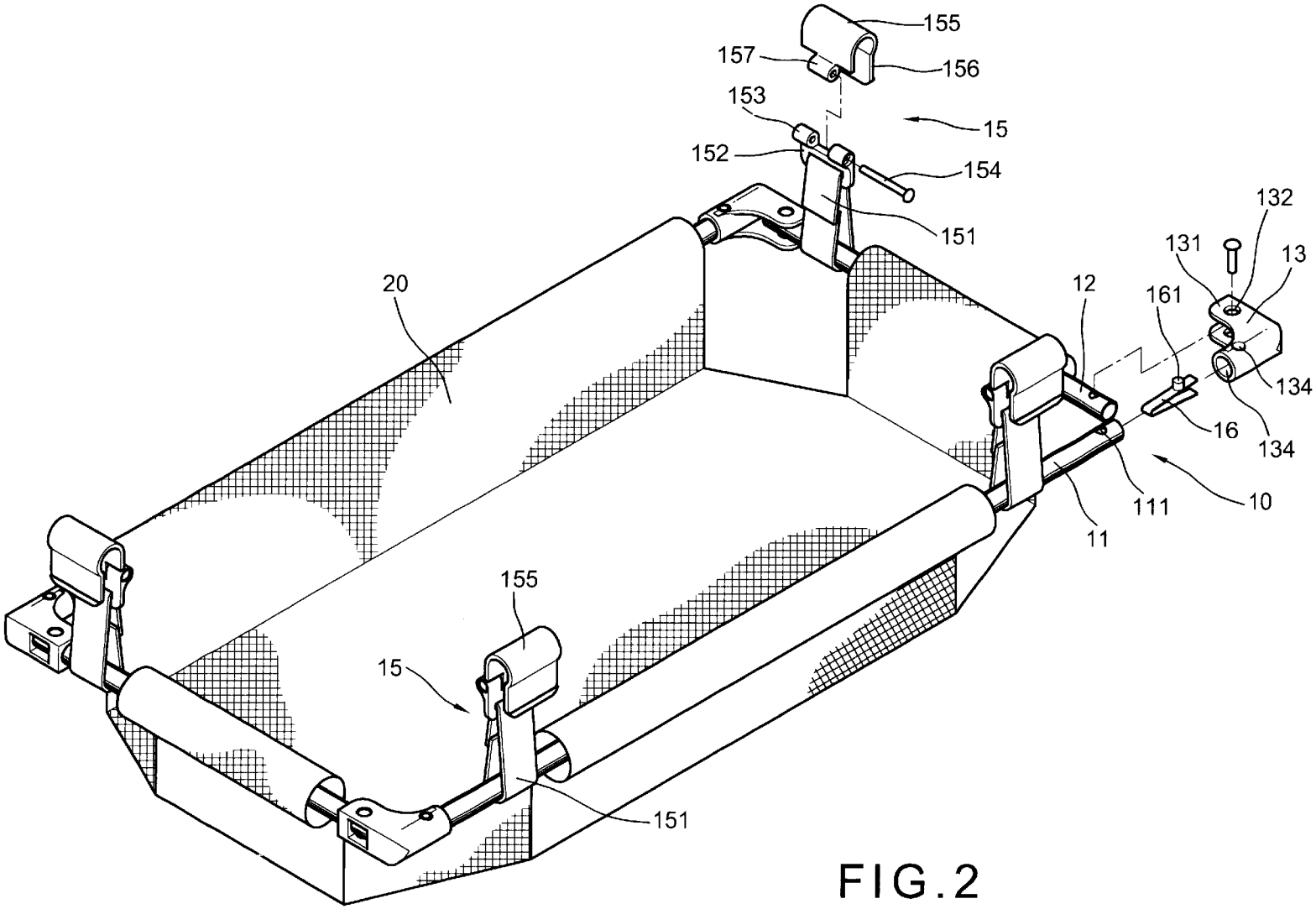
FIG. 2 is a perspective view to show a preferred embodiment of the present invention.
Figure 3:
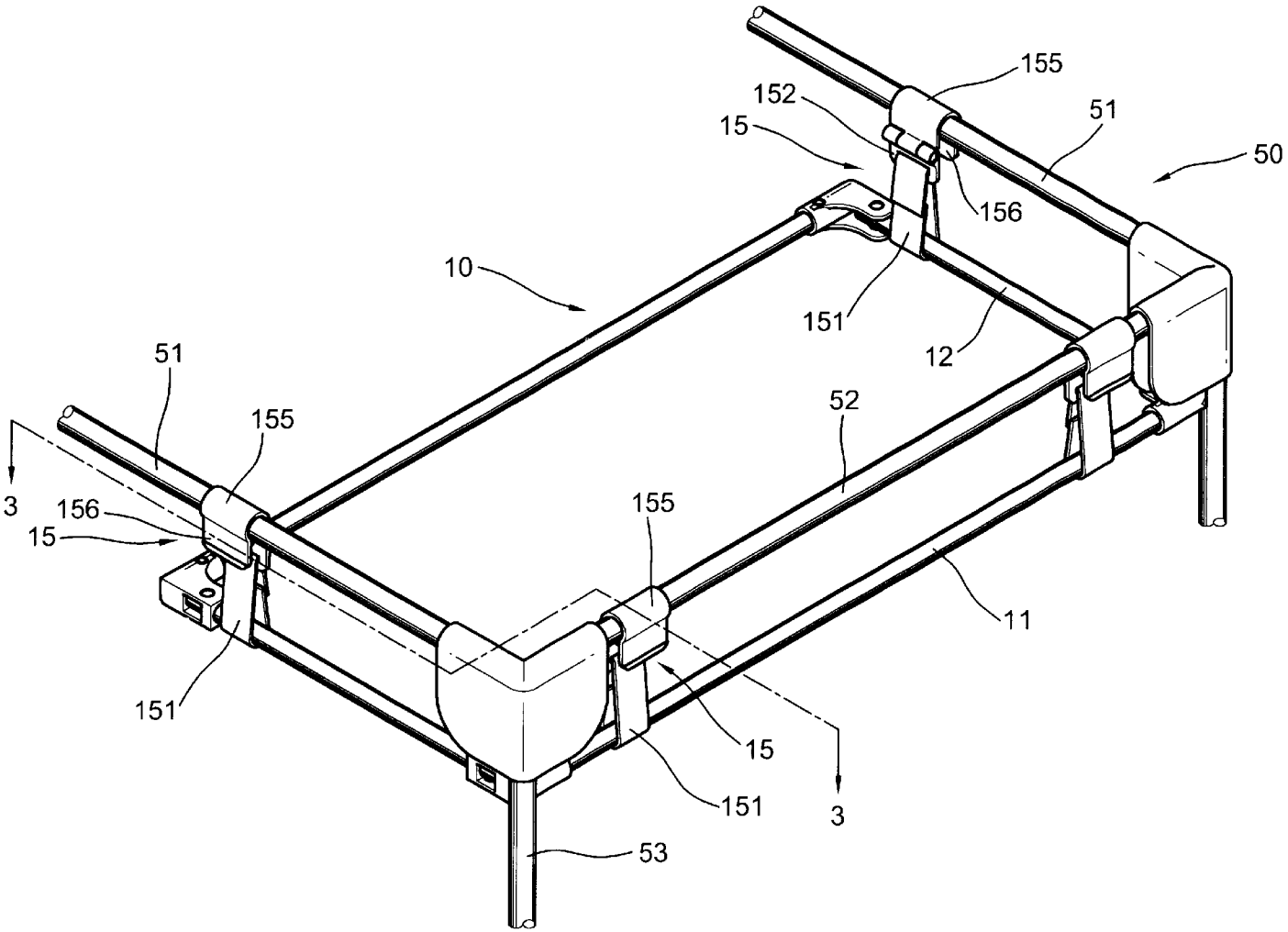
FIG. 3 is a perspective view to show a collapsible leaf of the present invention suspending from a playpen.

With reference to FIGS. 2 and 3 of the drawings, the collapsible leaf 10 for a playpen according to the present invention comprises a pair of longitudinal bars 11 and a pair of transverse bars 12 each including a through hole abutting two ends connected at their ends by four corner members 13 and wrapped by a piece of cloth 20.

The corner members 13 each has a U-shaped opening with an aligned through hole 132 for connecting the ends of transverse bars 12 by rivet and a circular opening 133 with a first vertical recess 134 for connecting the ends of the longitudinal bars 11. A V-shaped spring plate 16 including a projection 161 inserted into each end of the longitudinal bars 11. The projection 161 is engaged into a second vertical recess 111 of the bar 11 and the first vertical recess 134 of the corner members 13. So that the corner members 13 are readily to disassemble with the bars 11 and 12 in order to conveniently change the cloth 20.

Four suspenders 15, two of them connected to a pair of transverse bars 12 respectively and two of the connected to one of the longitudinal bars 11 adjacent their ends thereof.

Figure 4:
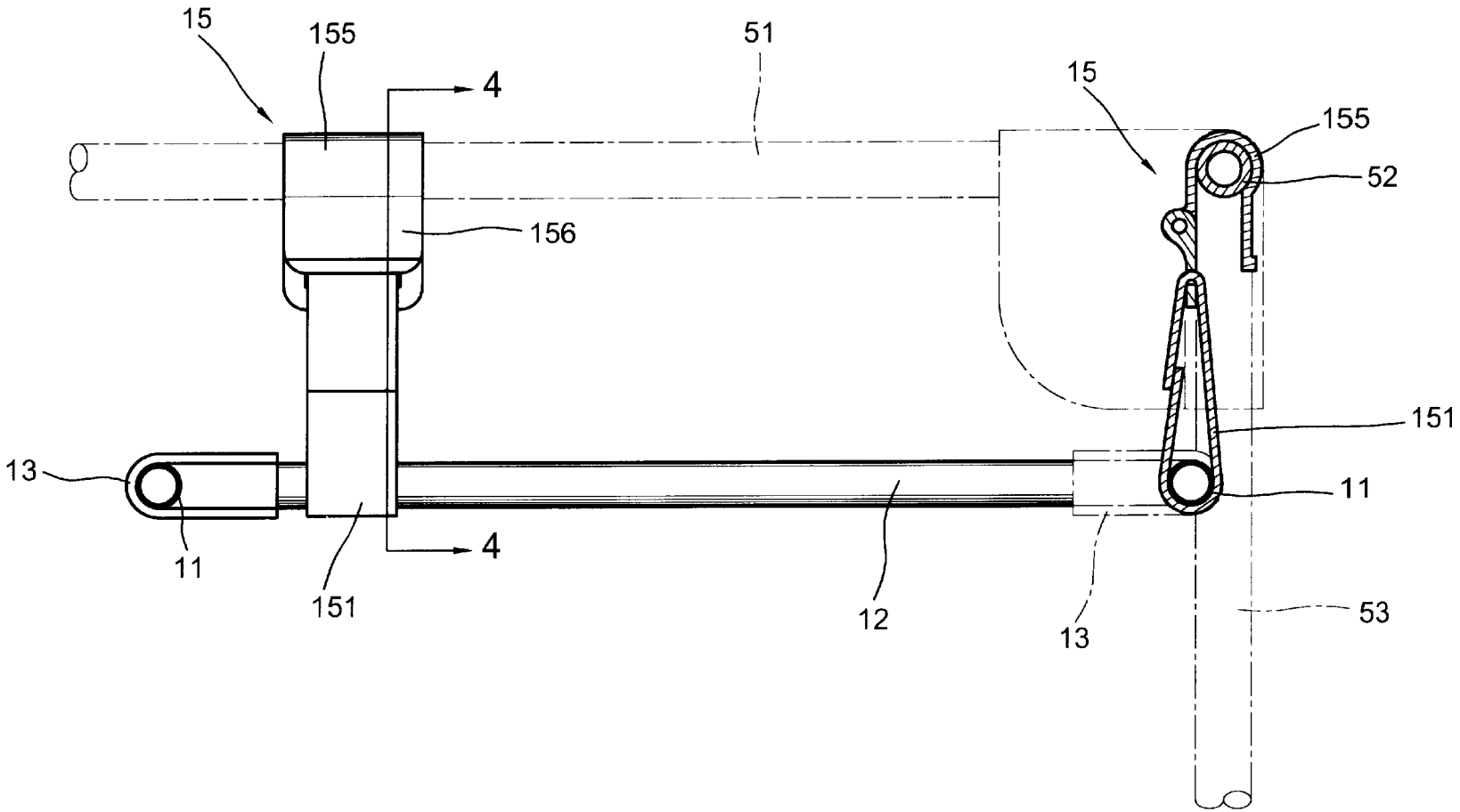
FIG. 4 is a perspectively with partially sectional view taken along line 3—3 of FIG. 3 showing that the transverse bars of the collapsible leave connected with the playpen.
Figure 5:
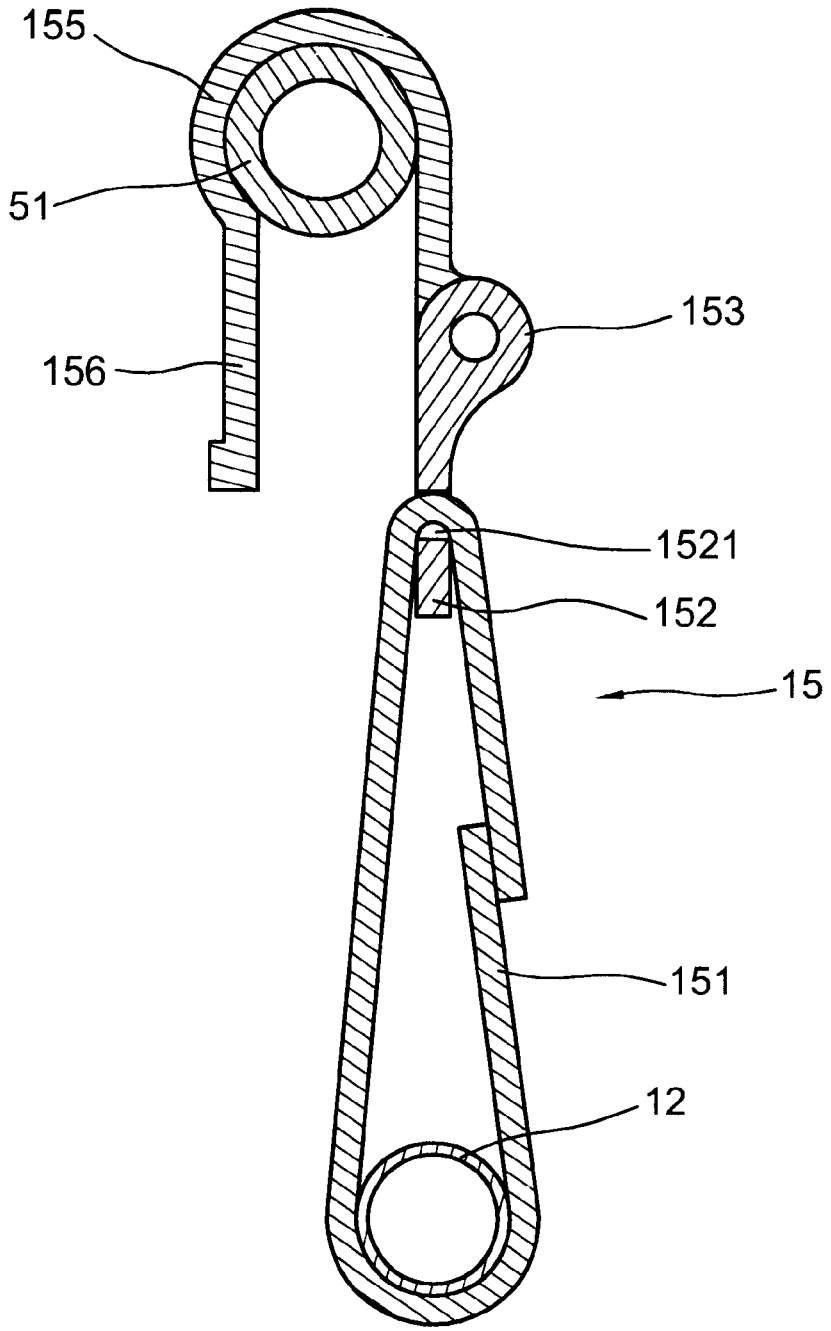
FIG. 5 is a sectional view taken along line 4—4 of FIG. 4.

The suspenders 15 each includes a strap 151 respectively wrapped on the bars 11 and 12, a buckle 152 connected with the strap 151 and a hook 155 hingedly connected with the buckle 152. The buckle has a pair of retaining rings 153 engageable with a single retaining 157 of the hook 155 so that the hook 155 is hinged with buckle 152 by a pin 154. The hook 155 further has a elastic plate 156 extending downward engageable with the rails 51 and 52 of the playpen 50. Therefore, the collapsible leaf 10 is suspending from the rails 51 and 52 by the four suspenders 15 of which the hooks 155 are holed on the rails 51 and 52 in a snap fitting (as shown in FIGS. 3, 4 and 5). Upon such arrangement, the collapsible leaf 10 of the present invention facilitate a mother to place the toys, milk bottle, or other things required to feed a baby.

Figure 6:
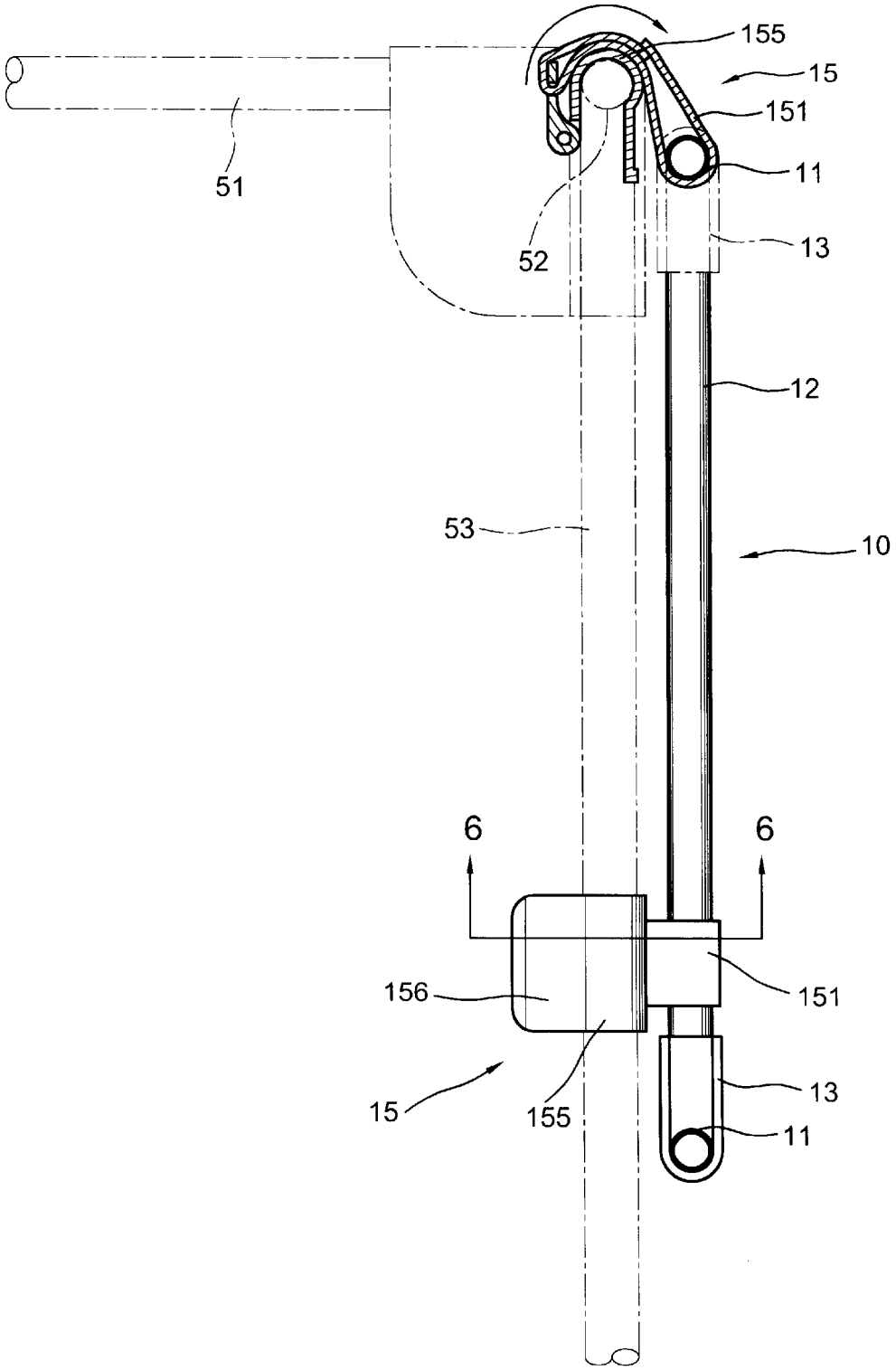
FIG. 6 is a perspective view with partial sectional view showing that the collapsible leaf is turned over and fixed to the uprights of the playpen.
Figure 7:
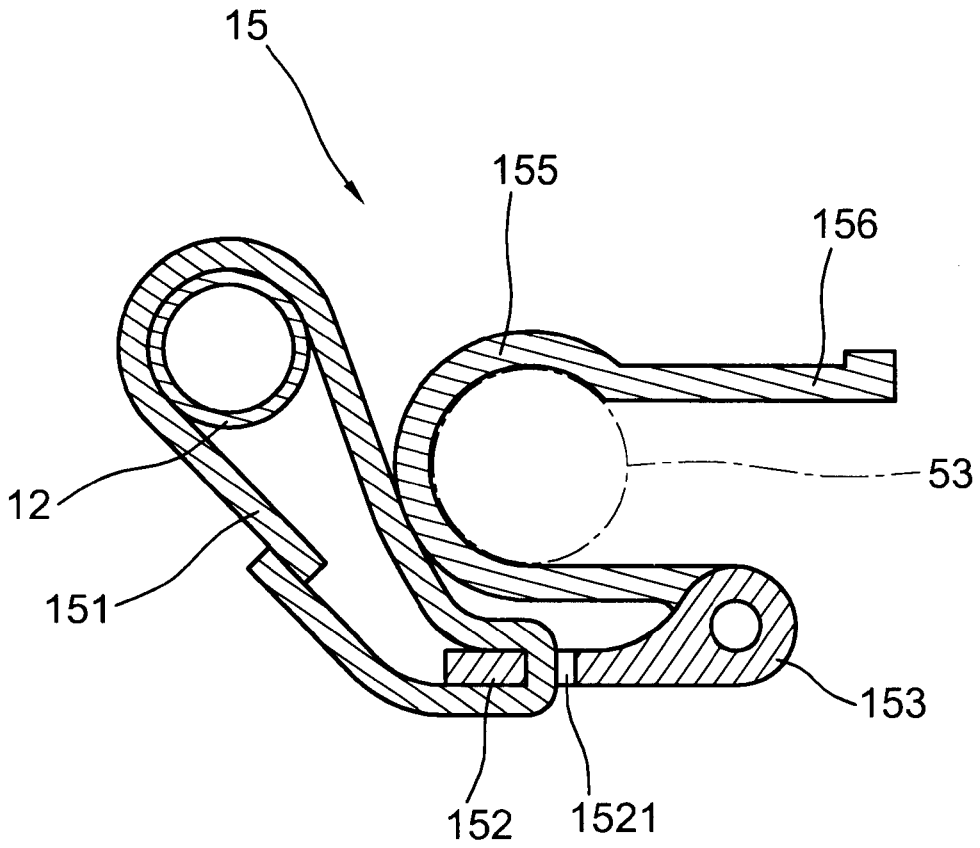
FIG. 7 is a sectional view taken along line 6—6 of FIG. 6.
Figure 8:
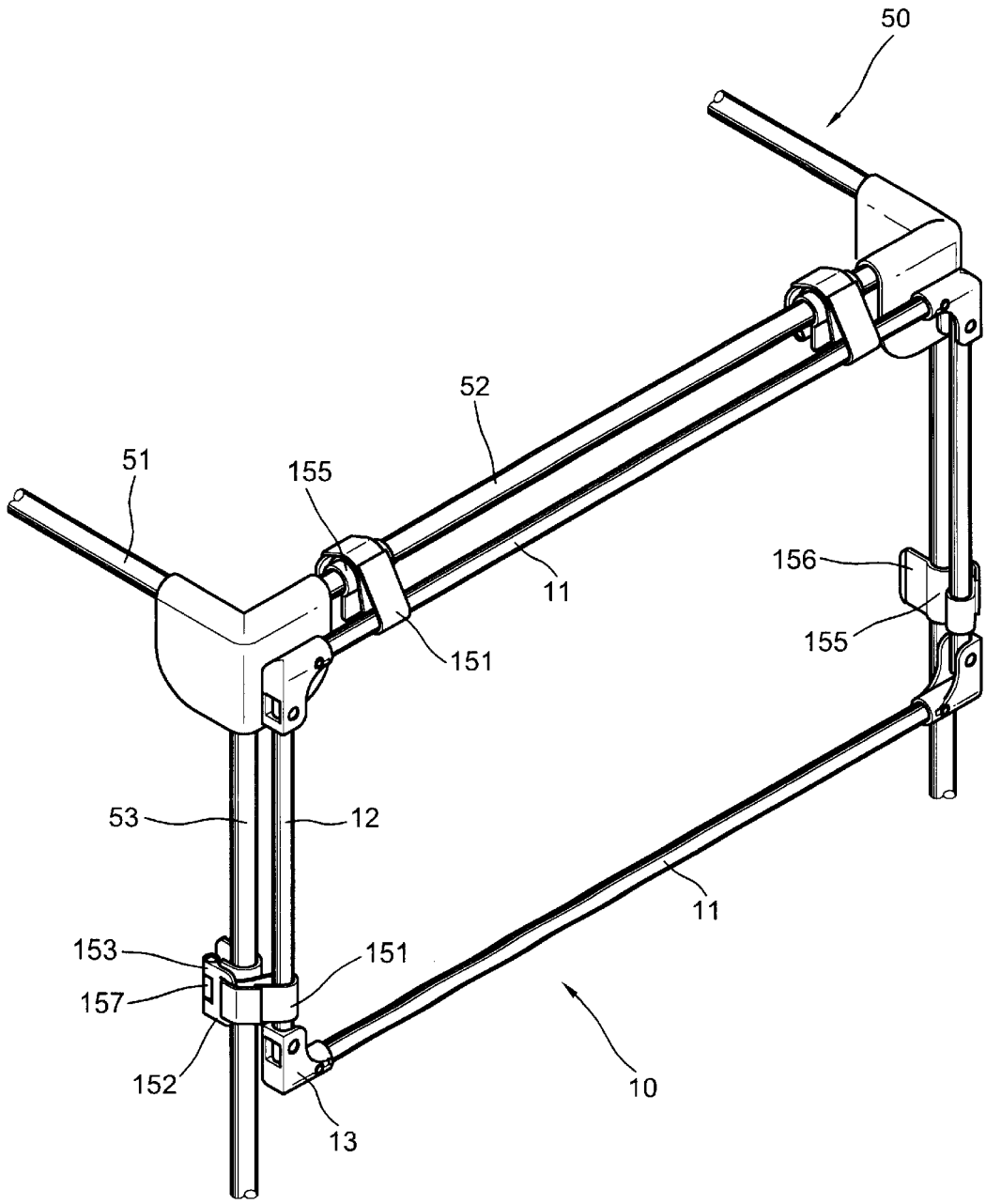
FIG. 8 is a perspective view of FIG. 6.

Referring to FIGS. 6, 7 and 8 when not in use, one can readily disengage the pair of hooks 155 with the rails 51 of the playpen 50 and turn the collapsible leaf 10 outward to have it still suspended from the rail 52 by other two suspenders 15. Then releasibly fixes the collapsible leaf on outside of the playpen 50 by engaging the hook 155 from the rails 51 with the uprights 53 of the playpen 50 respectively (as shown in FIG. 8).

The length of the strap 151 is adjustable to facilitate the overturning of the collapsible leaf 10, the hook 155 is hinged with the buckle 152 to facilitate the hook 155 changing it's directions and the elastic plate 156 provides a ready engagement or disengagement of the hook 155 with the rails 51 and/or the uprights 53 of the playpen 50.

The specification relating to the above embodiment should be construed as exemplary rather than as limitative of the present invention,with many variations and modifications being readily attainable by a person of average skill in the art without departing from the sprit or scope thereof as defined by the appended claims and their legal equivalents.

I claim:

1. A collapsible leaf for a playpen comprising:

a pair of longitudinal bars each including a first vertical recess abutting each end;

a pair of transverse bars each including a thru hole abutting each end;

four corner members connecting the ends of the pair of longitudinal bars and the pair of transverse bars, said corner members each including a U-shaped opening with an aligned thru hole for connecting the ends of the transverse bars by means of rivets and a circular opening with a second vertical recess for releasibly connecting the ends of the longitudinal bars by a V-shaped spring plate which has a projection on a top engaged into the first vertical recess of the longitudinal bar and the second vertical recess of the corner member in a snap fitting;

two pair of suspenders wherein a first pair of the suspenders engaged with the transverse bars respectively adjacent an inner end thereof and a second pair of suspenders engaged with the longitudinal bars adjacent two ends thereof, said suspenders each including a strap wrapped on the transverse bars of the longitudinal bar respectively, a buckle connected with the strap having a pair of retaining rings on top thereof and a hook having a single retaining ring engaged with the pair of retaining rings of the buckle for hinging the hook with the buckle by means of a pin and a elastic plate extending downward for hooding the hooks with upper rails of a playpen respectively; a piece of cloth is wrapped on said longitudinal bars and transverse bars respectively.

* * * * *